US008467271B2

(12) United States Patent
Hirokawa

(10) Patent No.: US 8,467,271 B2
(45) Date of Patent: Jun. 18, 2013

(54) DATE DISPLAYING APPARATUS

(75) Inventor: Jyunichi Hirokawa, Akishima-shi (JP)

(73) Assignee: Casio Computer Co., Ltd, Tokyo (JP)

( * ) Notice: Subject to any disclaimer, the term of this patent is extended or adjusted under 35 U.S.C. 154(b) by 280 days.

(21) Appl. No.: 12/942,169

(22) Filed: Nov. 9, 2010

(65) Prior Publication Data

US 2011/0134726 A1 Jun. 9, 2011

(30) Foreign Application Priority Data

Dec. 8, 2009 (JP) ..... 2009-278442

(51) Int. Cl.
*G04B 19/24* (2006.01)

(52) U.S. Cl.
USPC ..... 368/37

(58) Field of Classification Search
USPC ..... 368/37, 38, 35
See application file for complete search history.

(56) References Cited

U.S. PATENT DOCUMENTS

| | | | | |
|---|---|---|---|---|
| 2,580,458 | A * | 1/1952 | Ostevik | 368/37 |
| 3,518,825 | A * | 7/1970 | Nissen | 368/37 |
| 3,811,266 | A * | 5/1974 | Samura | 368/35 |
| 3,842,590 | A * | 10/1974 | Kato | 368/35 |
| 7,120,091 | B1 * | 10/2006 | Lizzi | 368/37 |
| 7,184,369 | B2 * | 2/2007 | Crettex | 368/28 |
| 2005/0105398 | A1 * | 5/2005 | Burkhardt et al. | 368/37 |
| 2006/0221773 | A1 * | 10/2006 | Kuepfer et al. | 368/37 |
| 2008/0094941 | A1 * | 4/2008 | Pellaton | 368/37 |

FOREIGN PATENT DOCUMENTS

| | | |
|---|---|---|
| JP | 45-38946 | 12/1970 |
| JP | 03-218492 | 9/1991 |
| JP | 2006-524801 | 11/2006 |

OTHER PUBLICATIONS

Japanese Office Action for Japanese Application No. 2009-278442 mailed on Oct. 11, 2011.

* cited by examiner

*Primary Examiner* — Vit W Miska
*Assistant Examiner* — Matthew Powell
(74) *Attorney, Agent, or Firm* — Turocy & Watson, LLP

(57) ABSTRACT

A date displaying apparatus includes: a rotating plate including an upper surface on which a plurality of numerals respectively indicating a plurality of dates are inscribed in a circular pattern; and a fix plate provided above the rotating plate, the fix plate having an aperture portion to expose numerals of a predetermined number, the numerals respectively indicating successive dates of a predetermined number (integer of two or more), among the plurality of numerals, wherein the numerals of the predetermined number respectively indicating the successive dates of the predetermined number are simultaneously displayed by the rotating plate and the fix plate, and the plurality of numerals respectively indicating the plurality of dates include all arrangements of the numerals of the predetermined number respectively indicating the successive dates of the predetermined number which can appear on a calendar.

10 Claims, 6 Drawing Sheets

DATE DISPLAYING APPARATUS

CROSS-REFERENCE TO RELATED APPLICATIONS

This application is based upon and claims the benefit of priority from the prior Japanese Patent Application No. 2009-278442 filed on 8 Dec. 2009, the entire contents of which are incorporated herein by reference.

BACKGROUND OF THE INVENTION

1. Field of the Invention

The present invention relates to a date displaying apparatus using a rotating plate.

2. Description of Related Art

There has conventionally been used an analog timepiece which displays a time and date using hands and a date indicator. The analog timepiece rotates the date indicator, on which the numerals of 1-31 are inscribed, below a dial plate in which a small window is formed. By exposing only the numeral corresponding to a date from the small window, the date is displayed. However, since the number of dates per month is different among February, a short month (month of thirty days or less), and a long month (month of thirty-one days), if the date indicator simply rotates through a rotation angle of one day every day according to such displaying method, the displayed date becomes discrepant from an actual date. Accordingly, there has been proposed a technique to provide a section for counting months and days to control a rotation angle of the date indicator at the end of a month in order to suitably display a date, in Japanese Patent Application Laid-Open Publication No. H3-218492.

Moreover, there have hitherto been an analog timepiece which exposes successive dates of three days including the previous day and the succeeding day from a small window, and an analog timepiece which exposes the dates of one week so that the dates respectively correspond to displayed days of a week provided on a dial plate. In such analog timepieces, if using the aforesaid date indicator on which the numerals of 1-31 are inscribed, the display becomes incorrect when displaying the dates over February or the short month and the following month. Accordingly, there has been proposed a technique for correcting a display of a wrist watch which displays the dates of one week by further providing a correction dial plate on which the numerals of 1-6 were inscribed to the wrist watch, and by driving the correction dial plate to cover the unnecessary dates and incorrect dates on the rotating dial plate of the wrist watch when displaying the dates over February or the short month and the following month, in Japanese Translation Publication of PCT International Application No. 2006-524801.

However, the conventional technique needs to use a plurality of dial plates and a plurality of motors in order to suitably display a plurality of successive dates over two months by controlling the rotations of rotating plates, and there has been a problem that an operation and a structure become complex.

SUMMARY OF THE INVENTION

It is an object of the present invention to provide a date displaying apparatus having a function to enable always displaying a plurality of successive dates accurately and simply.

To solve the problem, there is provided a date displaying apparatus, including:

a rotating plate including an upper surface on which a plurality of numerals respectively indicating a plurality of dates are inscribed in a circular pattern; and a fix plate provided above the rotating plate, the fix plate having an aperture portion to expose numerals of a predetermined number, the numerals respectively indicating successive dates of a predetermined number (integer of two or more), among the plurality of numerals, wherein the numerals of the predetermined number respectively indicating the successive dates of the predetermined number are simultaneously displayed by the rotating plate and the fix plate, and arrangements of the plurality of numerals inscribed on the rotating plate include:

a first arrangement in which numerals 1-31 respectively indicating dates of a long month whose month-end date is 31$^{st}$ day are arranged along a predetermined direction in order;

a second arrangement in which numerals respectively indicating dates from 1$^{st}$ day to a (predetermined number—1)$^{th}$ day and numerals respectively indicating dates from a date which is a (predetermined number—2)$^{th}$ day earlier than a first month-end date of a first short month among the first month, a second month and a third short months whose month-end dates are not 31$^{st}$ day, to the first month-end date along the predetermined direction in order;

a third arrangement in which the numerals respectively indicating the dates from 1$^{st}$ day to the (predetermined number—1)$^{th}$ day and numerals respectively indicating dates from a date which is a (predetermined number—2)$^{th}$ day earlier than a second month-end date of the second short month, to the second month-end date along the predetermined direction in order; and a fourth arrangement in which the numerals respectively indicating the dates from 1$^{st}$ day to the (predetermined number—1)$^{th}$ day and numerals respectively indicating dates from a date which is a (predetermined number—2)$^{th}$ day earlier than a third month-end date of the third short month, to the third month-end date along the predetermined direction in order.

According to the present invention, an advantage of enabling a date displaying apparatus which uses a rotating plate to always display successive dates of a predetermined number accurately and simply can be obtained.

BRIEF DESCRIPTION OF THE DRAWINGS

The present invention will sufficiently be understood by the following detailed description and accompanying drawing, but they are provided for illustration only, and not for limiting the scope of the invention.

DETAILED DESCRIPTION OF THE PREFERRED EMBODIMENTS

In the following, an embodiment of the present invention will be described with reference to the accompanying drawings.

Figure 1:
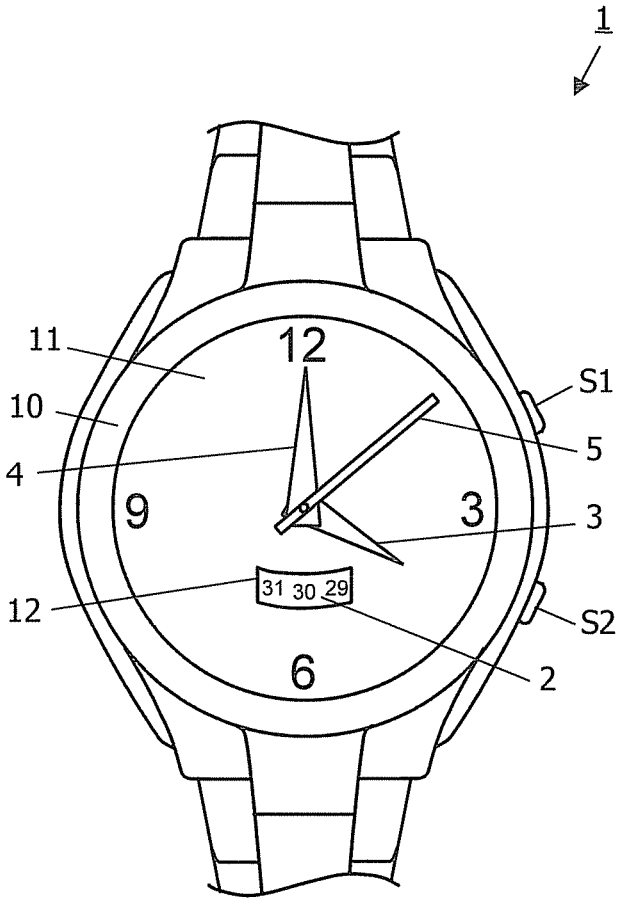
FIG. 1 is a front view showing an electronic timepiece of an embodiment of the present invention.

FIG. 1 is a front view of an electronic timepiece according to an embodiment of a date displaying apparatus of the present invention.

An electronic timepiece 1 of the present invention is a hand pointer type electronic watch having a function to display a time and a date simultaneously by using hands and a rotating plate. The electronic timepiece 1 is provided with a dial plate 11 which includes numerals indicating times and which is inside a space enclosed by a casing 10 holding an internal mechanism of the electronic timepiece 1 therein, and a windshield glass covering a front surface of the electronic timepiece 1. The electronic timepiece 1 has a configuration in which hands composed of an hour hand 3, a minute hand 4, and a second hand 5 are rotatably arranged so that the hour hand 3, the minute hand 4, and the second hand 5 respectively display an hour, a minute, and a second by pointing the numerals on the dial plate 11. On the right side surface of the casing 10, switches S1 and S2 for performing input operations by being depressed are provided.

At a center of the dial plate 11, a hole through which rotation shafts (see FIG. 2) of the hands 3-5 penetrate is formed, and a small window 12 is formed in a direction of 6 o'clock. The electronic timepiece 1 is equipped with a date indicator 2 which is rotatably provided under the dial plate 11, and a part of an upper surface of the date indicator 2 is exposed through the small window 12. The small window 12 may be a through-hole, or may be composed of a transparent member (for example, glass).

Figure 2:
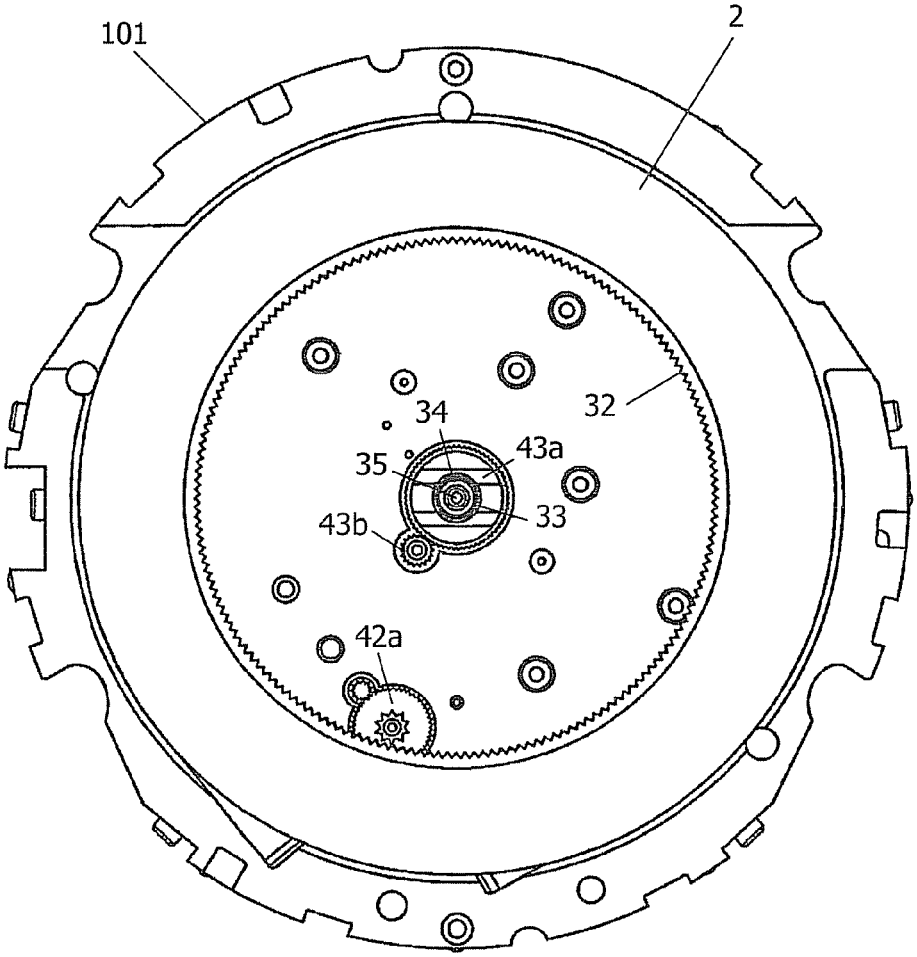
FIG. 2 is a plan view showing a structure under a dial plate of the electronic timepiece of FIG. 1.

FIG. 2 is a plan view showing a structure under the dial plate 11 of the electronic timepiece 1.

Under the dial plate 11, an hour hand shaft 33, a minute hand shaft 34, and a second hand shaft 35, which rotate together with the hands 3-5, are coaxially arranged at the center of the dial plate 11. The hour hand shaft 33 is configured to rotate through a train wheel mechanism including a minute wheel 43*b* which is driven to rotate by a step motor, and an hour wheel 43*a*.

The date indicator 2 is an annular member which is formed by removing a central part of a round shape from a disk and has an internal gear portion 32 along an inner edge of the date indicator 2. This date indicator 2 is rotatably held by a machine casing 101, and rotates around the same axis as those of the hands 3-5 through a train wheel mechanism including a spur gear 42*a* driven to rotate by a step motor.

On the upper surface of the date indicator 2, a plurality of numerals to be hereinafter described in detail is provided at regular intervals on a circumference of a circle distant from the central axis by the same distance as that of the small window 12 from the central axis, and three numerals of the plurality of numerals are exposed from the small window 12.

Figure 3:
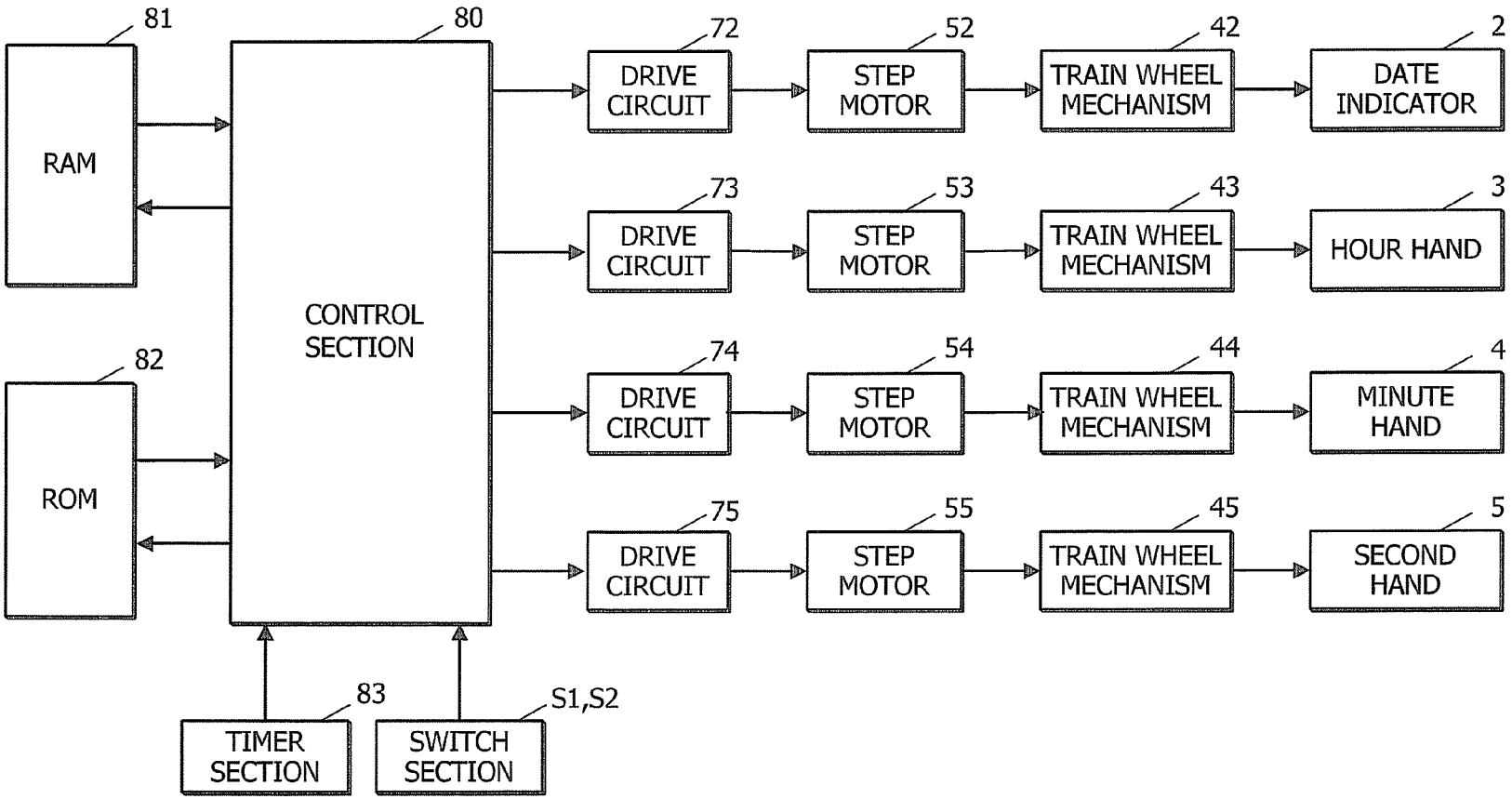
FIG. 3 is a block diagram showing an internal configuration of the electronic timepiece of FIG. 1.

FIG. 3 is a block diagram showing an internal configuration of the electronic timepiece 1.

The electronic timepiece 1 is equipped with: a control section 80 (a rotating plate drive control section, a hand drive control section) which includes a central processing unit (CPU) to perform a control of the whole apparatus; a random access memory (RAM) 81 which provides a working memory space to the CPU of the control section 80; a read only memory (ROM) 82 which stores programs and setting data for performing various controls of operations of the electronic timepiece 1; a timer section 83 (a date counting section, a present time counting section) which frequency-divides a signal having a predetermined frequency input from a not-shown oscillating circuit to count data of dates and times; switch sections S1 and S2 for performing input operations from outside; the date indicator 2; a train wheel mechanism 42 which has a plurality of gears including the spur gear 42*a* and rotates the date indicator 2 by a predetermined angle; the hour hand 3; a train wheel mechanism 43 which has a plurality of gears including the hour wheel 43*a* and the minute wheel 43*b* and rotates the hour hand 3 by a predetermined angle; train wheel mechanisms 44 and 45 which have a plurality of gears and rotate the minute hand 4 and the second hand 5 by a predetermined angle respectively; step motors 52-55 which rotate the gears of the train wheel mechanisms 42-45 by a predetermined angle respectively; drive circuits 72-75 each of which transmits a signal to each of the step motors 52-55 on the basis of an instruction from the control section 80 to independently drive the respective step motors 52-55.

The control programs and the setting data included in the ROM 82 include a table showing the number of dates of each month and a calculation program for a leap year. These table and calculation program are read by the CPU of the control section 80 at the time of changing a date to be used for the counting of date data by the timer section 83, for the rotation processing by the date indicator 2, and the like.

The timer section 83 frequency-divides the signal having a predetermined frequency input from the oscillating circuit (not shown), and counts hours, minutes, seconds, times less than a second, years, months, and days to hold the counted values. These counted values are corrected by overwriting according to an instruction input from the switch sections 51 and 52.

Although the embodiment has a configuration in which the hour hand 3 and the minute hand 4 are independently driven by the different drive circuits 73 and 74 and the different step motors 53 and 54 respectively, also a configuration in which the train wheel mechanisms 43 and 44 are driven with one drive circuit and one step motor may be adopted. Also a configuration including a different hand such as a small hand besides the date indicator 2 and the hands 3-5 may be adopted.

Next, the arrangement of the numerical values inscribed on the upper surface of the date indicator 2 will be described.

Figure 4:
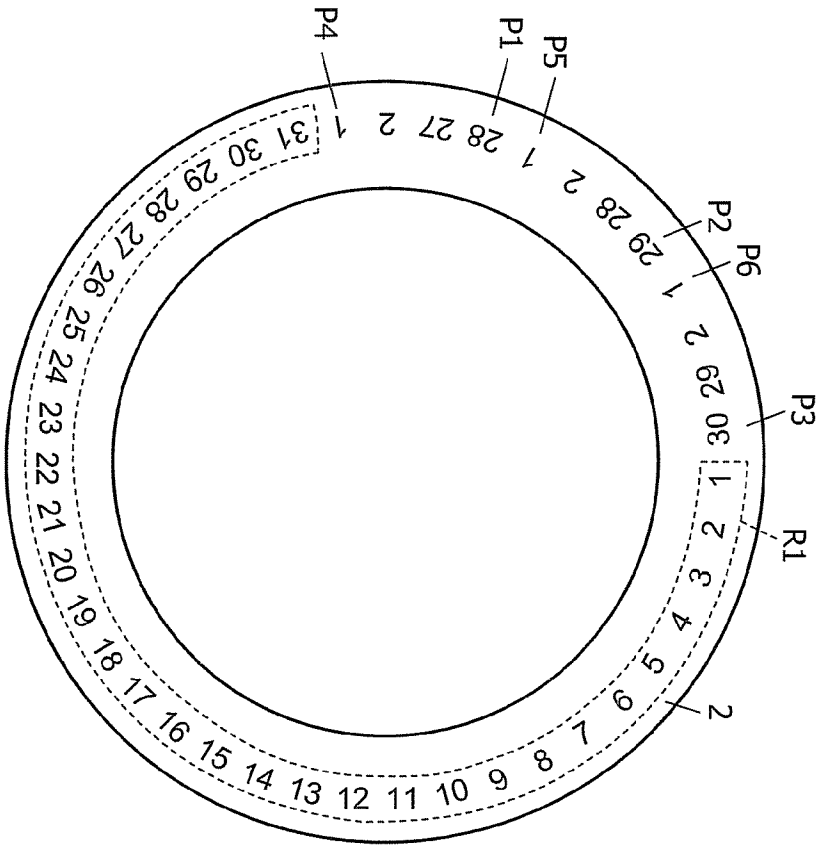
FIG. 4 is a plan view showing an example of an arrangement of numerals which indicates dates and which are inscribed on an upper surface of a date indicator of the electronic timepiece of FIG. 1.

FIG. 4 is a plan view showing an example of the arrangement of the numerals indicating dates which are provided on the upper surface of the date indicator 2.

As shown in FIG. 4, a plurality of numerals respectively indicating a plurality of dates are arranged in a circular pattern on the circumference of the same circle on the date indicator 2 of the embodiment. These numerals are arranged as follows: numerals "1-31" are provided in order at regular intervals (region R1); following the region R1, three sets of numeral arrangements "1 (position P4), 2, 27, 28 (position P1)," "1 (position P5), 2, 28, 29 (position P2)," and "1 (position P6), 2, 29, 30 (position P3)" are continuously added in order; and the order returns to the first numeral "1" after one round.

As the arrangements of the dates of successive three days in a solar calendar, there are eight types of arrangements in addition to 29 types of "1, 2, 3," "2, 3, 4," . . . "29, 30, 31." The eight types are: "30, 31, 1" and "31, 1, 2" over the long month and the following month; "29, 30, 1" and "30, 1, 2" over the short month and the following month; "28, 29, 1" and "29, 1, 2" over February in the leap year and the following month; and "27, 28, 1" and "28, 1, 2" over February in a year except the leap year and the following month. These eight types of the arrangements of the dates can be expressed, as shown in FIG. 4, by providing arrangements of combinations of one or two of dates (1, 2) at the beginning of respective months having the respective numbers of dates and one or two of any dates of (27, 28), (28, 29), (29, 30), and (30, 31) at the end of the respective months, with respect to the numbers (28, 29, 30, 31) of dates of respective months. Consequently, it becomes possible to display all 37 types of arrangements of the dates of successive three days by using 43 numerals in total on the one date indicator 2.

Although the numerals are shown as Arabic numerals in the embodiment, Chinese numerals or the like can be used as long as the numerals can express the respective dates of 1-31.

Next, control processing of rotation of the date indicator 2 at the time of change of a date display will be described with reference to a flowchart.

Figure 5:
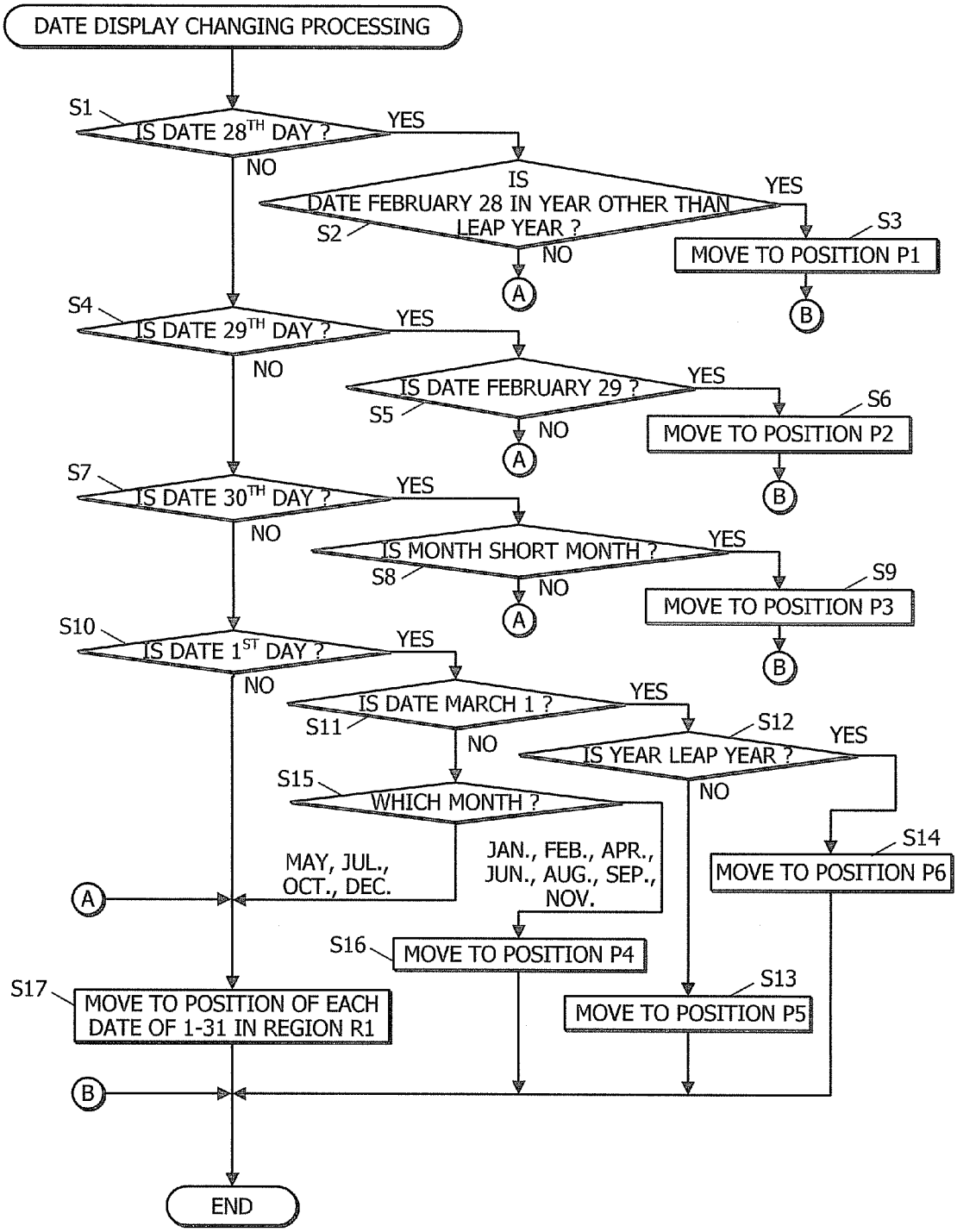
FIG. 5 is a flowchart showing a control procedure of a date displaying processing by the central processing unit (CPU) of the electronic timepiece of FIG. 1.

FIG. 5 is a flowchart showing a control procedure of date display changing processing by the CPU of the control section 80.

This control processing is automatically started at a predetermined time around the change of the date every day and is performed.

When the control processing is started, the CPU first judges whether or not a date to be changed is $28^{th}$ day (Step S1). Then, when the date is $28^{th}$ day, the processing shifts to Step S2, and the CPU judges whether or not the date is February 28 and whether or not the date is a date of the year other than the leap year. When the year is not the leap year, the processing branches to the case of "YES" and shifts to Step S3. Then, the CPU drives the data indicator 2 to rotate so that the numeral "28" at the position P1 on the data indicator 2 shown in FIG. 4 is displayed at the center of the small window 12, and ends the date display changing processing. When the month is not February, or when the year is the leap year, the processing branches to the case of "NO" and shifts to Step S17.

When the judgment processing judges that the date is not $28^{th}$ day at Step S1, the processing shifts to Step S4, and the CPU judges whether or not the date to be changed is $29^{th}$ day. Then, when the date is $29^{th}$ day, the processing shifts to Step S5, and the CPU judges whether or not the date is February 29. When the date is February 29, the processing shifts to Step S6. Then, the CPU drives the data indicator 2 to rotate so that the numeral "29" at the position P2 on the data indicator 2 shown in FIG. 4 is displayed at the center of the small window 12, and ends the date display changing processing. When the date is not February 29, the processing shifts to Step S17.

When the judgment processing judges that the date is not $29^{th}$ day at Step S4, the processing shifts to Step S7, and the CPU judges whether or not the date to be changed is $30^{th}$ day consecutively. Then, when the date is $30^{th}$ day, the processing shifts to Step S8, and the CPU judges whether or not the date is $30^{th}$ day of the short month, namely April, June, September, or November. When the date is $30^{th}$ day of the short month, the processing shifts to Step S9. Then, the CPU drives the data indicator 2 to rotate so that the numeral "30" at the position P3 on the data indicator 2 shown in FIG. 4 is displayed at the center of the small window 12, and ends the date display changing processing. When the day is not $30^{th}$ day of the short month, the processing shifts to Step S17.

When the judgment processing judges that the day is not $30^{th}$ day at Step S7, the processing shifts to Step S10, and the CPU judges whether or not the date to be changed is $1^{st}$ day. Then, when the date is $1^{st}$ day, the processing shifts to Step S11, and the CPU judges whether or not the date to be changed is March 1. When the date is March 1, the CPU consecutively judges whether or not the year is the leap year (Step S12).

When the year is not the leap year, the CPU drives the data indicator 2 to rotate so that the numeral "1" at the position P5 on the data indicator 2 shown in FIG. 4 is displayed at the center of the small window 12 (Step S13). On the other hand, when the year is the leap year, the CPU drives the data indicator 2 to rotate so that the numeral "1" at the position P6 on the data indicator 2 shown in FIG. 4 is be displayed at the center of the small window 12 (Step S14). Then, in both the cases, the CPU ends the date display changing processing.

When the judgment processing judges that the date is $1^{st}$ day of a month other than March at Step S11, the CPU next judges whether or not the month is the next month of the short month, namely whether or not the month is any of May, July, October and December (Step S15). When a result of the judgment is "YES," the processing shifts to Step S17. When the result of the judgment is "NO," the processing shifts to Step S16, and the CPU drives the date indicator 2 to rotate so that the numeral "1" at the position P4 on the date indicator 2 shown in FIG. 4 is displayed at the center of the small window 12, and ends the date display changing processing.

When the processing shifts to Step S17, namely in the cases that the date is $28^{th}$ day of the month other than February or $28^{th}$ day of February of the year other than the leap year, that the date is $29^{th}$ day of the month other than February, that the date is $30^{th}$ or $31^{st}$ days of the long month, that the date is $1^{st}$ day of any of May, July, October and December, and that the date is any of 2-$27^{th}$ days of all the months, the CPU drives the date indicator 2 to rotate so that the numeral same as the corresponding date in the region R1 shown on the date indicator 2 of FIG. 4 is displayed at the center of the small window 12, and ends the date display changing processing.

In addition, the orders of the date judgment processing at Steps S1, S4, S7, and S10 can mutually be exchanged.

The arrangement order of the numerals indicating respective dates is not limited to the aforesaid one. For example, the order of the arrangement of the three sets of numerals provided after the arrangement of the numerals "1-31" in the region R1 can mutually be exchanged. In other words, the following orders may be adopted:

"1, 2, 27, 28, 1, 2, 29, 30, 1, 2, 28, 29";
"1, 2, 28, 29, 1, 2, 27, 28, 1, 2, 29, 30";
"1, 2, 28, 29, 1, 2, 29, 30, 1, 2, 27, 28";
"1, 2, 29, 30, 1, 2, 27, 28, 1, 2, 28, 29"; and
"1, 2, 29, 30, 1, 2, 28, 29, 1, 2, 27, 28", in addition to the order of
"1, 2, 27, 28, 1, 2, 28, 29, 1, 2, 29, 30."

Furthermore, the arrangement of all the dates can be expressed also by arranging the numerals "1-28" as the numerals provided in the region R1, and by adding 15 numerals "1, 2, 28, 29, 1, 2, 29, 30, 1, 2, 27, 28, 29, 30, 31" subsequently to the region R1. Also in this case, the order of the arrangement of three sets of numerals "1, 2, 28, 29," "1, 2, 29, 30," and "1, 2, 27, 28, 29, 30, 31" can mutually be exchanged. In other words, the following six types of arrangements may be adopted:

"1, 2, 29, 30, 1, 2, 28, 29, 1, 2, 27, 28, 29, 30, 31";
"1, 2, 28, 29, 1, 2, 27, 28, 29, 30, 31, 1, 2, 29, 30";
"1, 2, 29, 30, 1, 2, 27, 28, 29, 30, 31, 1, 2, 28, 29";
"1, 2, 27, 28, 29, 30, 31, 1, 2, 29, 30, 1, 2, 28, 29"; and
"1, 2, 27, 28, 29, 30, 31, 1, 2, 28, 29, 1, 2, 29, 30."

Similarly, all the arrangements of the dates of successive three days can be obtained by 43 numerals in total also by changing the arrangement between the positions P5 and P2 to the numerals "1, 2, 28, 29, 30, 31" when the arrangement of the numerals in the region R1 is composed of the numerals of "1-29," or by changing the arrangement between the positions P6 and P3 to the numerals "1, 2, 29, 30, 31" when the arrangement of the numerals in the region R1 is composed of the numerals of "1-30."

By increasing the number of numerals to be more than 43 numerals, all the 37 types of the arrangements of the dates of successive three days can be expressed by further more arrangements. For example, it is also possible to provide all the arrangements of the numerals indicating the 37 types of the dates of successive three days by using 51 numerals in total by adding 20 numerals "1, 31, 1, 2, 27, 28, 1, 28, 1, 2, 28, 29, 1, 29, 1, 2, 29, 30, 1, 30" successively to the numerals "1-31."

The dates expressed by the arrangement in the region R1 are not limited to an arrangement from the beginning of a month to the end of the month. Also by adding 12 numerals "27, 28, 1, 2, 28, 29, 1, 2, 29, 30, 1, 2" successively to the arrangement of the numerals "15-31, 1-16" for example, all the arrangements of the dates of successive three days can be displayed by using 45 numerals in total.

It is also possible to display all the dates of successive three days by 111 numerals in all by providing all of the 37 types of the arrangements of numerals indicating successive three days, such as "1, 2, 3," "2, 3, 4," and "3, 4, 5," without overlapping.

[Modification]

Figure 6:
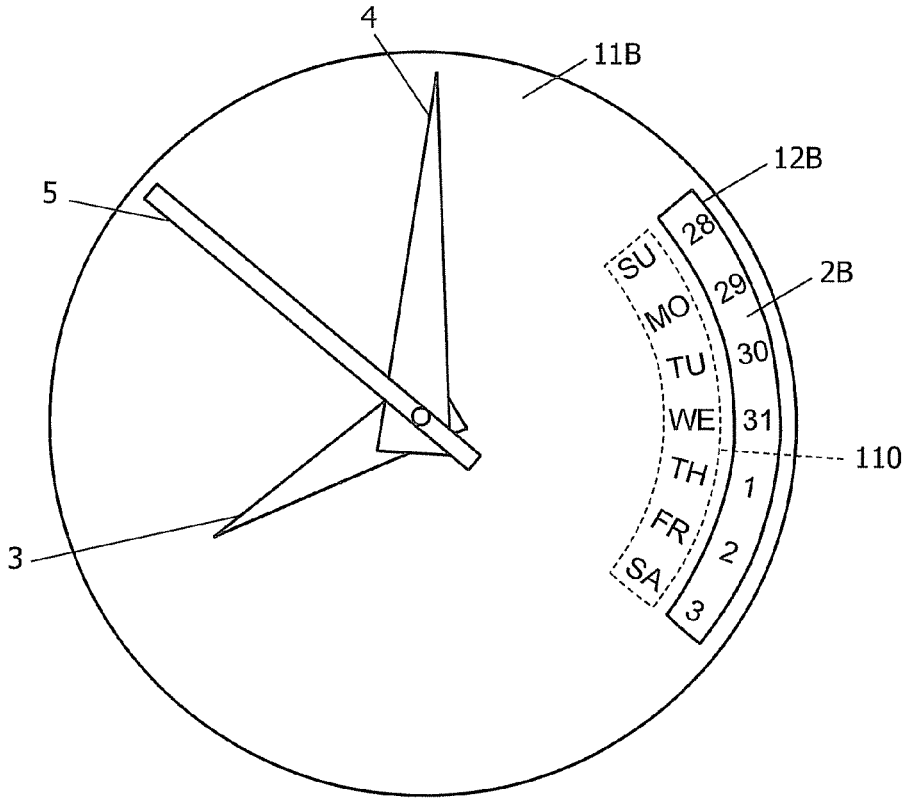
FIG. 6 is a plan view showing modifications of the dial plate and a rotating plate.

FIG. 6 is a plan view showing modifications of the dial plate and the aperture portion of the electronic timepiece.

In this modification, a small window 12B on a dial plate 11B is formed in the direction of 3 o'clock. The small window 12B can display the numerals indicating the dates of successive seven days. On the dial plate 11B of the modification, a display 110 of a character string "SU, MO, TU, WE, TH, FR, SA" indicating the respective days of a week from Sunday to Saturday is provided along the small window 12B. As shown in FIG. 6, for example, the numerals "28, 29, 30, 31, 1, 2, 3" on a date indicator 2B are exposed from the small window 12B at the end of the long month. Then, the date indicator 2B performs a rotation operation once a week around a change of date from Saturday to Sunday to display the dates of a new week correspondingly to the days of the week. In the example of FIG. 6, the numerals on the date indicator 2B exposed from the small window 12B are changed to numerals "4, 5, 6, 7, 8, 9, 10."

The arrangement of the numerical values expressed by the numerals provided on the date indicator 2B in this modification is, for example, "1, 2, 3 . . . 29, 30, 31, 1, 2, 3, 4, 5, 6, 23, 24, 25, 26, 27, 28, 1, 2, 3, 4, 5, 6, 24, 25, 26, 27, 28, 29, 1, 2, 3, 4, 5, 6, 25, 26, 27, 28, 29, 30." By such arrangement, all the date patterns of successive seven days can be displayed.

In this arrangement, the order of the arrangement of the three sets "1, 2, 3, 4, 5, 6, 23, 24, 25, 26, 27, 28," "1, 2, 3, 4, 5, 6, 24, 25, 26, 27, 28, 29," and "1, 2, 3, 4, 5, 6, 25, 26, 27, 28, 29, 30" provided successively to the arrangement of the numerals "1-31" can mutually be exchanged. Furthermore, as long as all the patterns of the dates of successive seven days are encompassed on the date indicator 2B similarly to the abovementioned embodiment displaying the dates of successive three days, the present invention can be executed even if the patterns are arranged in an arbitrary order or each of the patterns has an arbitrary number of numerals.

As described above, according to the electronic timepiece 1 of the embodiment of the present invention, a numerical sequence including all the arrangements of dates of successive three days that can appear on a calendar is displayed on the upper surface of the one date indicator 2. Consequently, the control section 80 only has to perform the processing to rotate the data indicator 2 to appropriate positions on the basis of the data of the timer section 83, and thereby also the dates of successive three days over two months can be displayed simply and accurately.

Moreover, on the upper surface of the one date indicator 2 rotatably provided under the dial plate 11, the dates of 1-31, and the dates of successive two days (1, 2) at the beginning of the month and the dates of successive two days (27, 28), (28, 29), (29, 30) at the end of the month with respect to the number of dates (28-30) per month other than 31 are represented in the circular pattern. In the dial plate 11, the aperture portion for exposing dates of successive three days therefrom is formed. Consequently, only by driving the date indicator 2 to rotate so as to expose a suitable part of the date indicator 2 in accordance with an instruction from the control section 80, it always becomes possible to expose the dates of successive three days to display them accurately and easily while an increase of the number of date numerals on the rotating plate 2 is suppressed.

Since all the dates of successive three days can be displayed by the rotation control of the date indicator 2 using software only by the combination of one drive circuit and one step motor, an increase of electric power consumption caused by using complex operations and a plurality of display mechanisms can be suppressed.

Since the timer section 83 counts dates and times collectively, a timepiece display and a date display can simultaneously be performed easily, and the timing for switching the display of dates can be controlled.

According to the electronic timepiece 1B of the modification, the number of displayed days is set to be seven, and a display of the days of a week is provided on the dial plate 11B. Thereby, the dates for one week and the days of a week can be displayed accurately and simply.

The scope of the present invention is not limited to the aforesaid embodiment, and various changes can be performed. For example, though the configurations of displaying successive three days or seven days have been displayed in the aforesaid embodiment, it is also possible to perform the display of, for example, successive two days or successive four days by changing the length of the small window 12 and the arrangement of the numerals indicating dates on the date indicator 2.

Moreover, the electronic timepiece of the aforesaid embodiment may be a wrist watch, a table clock, or a wall clock. Although the date display function built in the electronic timepiece is described in the aforesaid embodiment, the present invention can be used for the display of days of a calendar device displaying years, months, and days, and for a count-down device.

Although the rotating plate has the annular shape and the numeral arrangement indicating dates is the circular arrangement in the aforesaid embodiment, the rotating plate and the numeral arrangement may be formed in a fan-like shape. It is also possible to display successive dates by rolling up and rewinding a tape-like display member by electric control or manual operations. In addition, the details of the embodiment such as the position and shape of the small window and the arrangement and direction of the numerals can be suitably changed within a range without departing from the scope of the invention.

What is claimed is:

1. A date displaying apparatus, comprising:

a rotating plate including an upper surface on which arrangements of a plurality of numerals respectively indicating a plurality of dates are inscribed on a same circumference; and a fix plate provided above the rotating plate, the fix plate having an aperture portion to expose numerals, the numerals respectively indicating a successive predetermined number of dates (integer of two or more), among the arrangement of the plurality of numerals, wherein the numerals respectively indicating the successive predetermined number of dates are simultaneously displayed by the rotating plate and the fix plate, and the arrangements of the plurality of numerals inscribed on the rotating plate include:

a first arrangement in which numerals 1-31 respectively indicating dates of a long month whose month-end date is 31st day are arranged along a predetermined direction in order;

a second arrangement in which numerals respectively indicating dates from $1^{st}$ day to a (predetermined number—1)th day and numerals respectively indicating dates from a date which is a (predetermined number—2)th day earlier than a first month-end date of a first short month among the first month, a second month and a third short months whose month-end dates are not 31st day, to the first month-end date along the predetermined direction in order;

a third arrangement in which the numerals respectively indicating the dates from 1st day to the (predetermined number—1)th day and numerals respectively indicating dates from a date which is a (predetermined number—2)th day earlier than a second month-end date of the second short month, to the second month-end date along the predetermined direction in order; and a fourth arrangement in which the numerals respectively indicating the dates from 1st day to the (predetermined number—1)th day and numerals respectively indicating dates from a date which is a (predetermined number—2)th day earlier than a third month-end date of the third short month, to the third month-end date along the predetermined direction in order.

2. The date displaying apparatus according to claim 1, further comprising:

a date counting section to perform counting of a year, month, and day; and a rotating plate drive control section to electrically control the rotating plate to rotate based on data of the year, month, and day of the data counting section so that the numerals corresponding to the successive predetermined number of dates including a current day are exposed from the aperture portion.

3. The date displaying apparatus according to claim 1, further comprising:

a hand to rotate on the fix plate to point a time;

a present time counting section to count a present time; and a hand drive control section to drive-control the hand based on present time data of the present time counting section.

4. The date displaying apparatus according to claim 2, wherein the predetermined number is three, and the rotating plate drive control section controls the rotating plate to rotate so as to expose a numeral indicating a date of a current day and numerals respectively indicating a previous date and a next date with respect to the current day based on the data of the year, month, and day of the data counting section.

5. The date displaying apparatus according to claim 2, wherein the predetermined number is seven;

seven days of a week are inscribed on an upper surface of the fix plate in parallel with the aperture portion; and the rotating plate drive control section controls the rotating plate to rotate so as to expose the seven numerals respectively indicating the successive seven dates including the current day correspondingly to the displayed seven days of the week based on the data of the year, month, and day of the data counting section.

6. A date displaying apparatus, comprising: one rotating plate including an upper surface on which arrangements of a plurality of numerals respectively indicating a plurality of dates are inscribed on a same circumference; and a fix plate provided above the rotating plate, the fix plate having an aperture portion to expose numerals , the numerals respectively indicating a successive predetermined number of dates (integer of two or more), among the arrangements of the plurality of numerals, wherein the numerals respectively indicating the successive predetermined number of dates are simultaneously displayed by the rotating plate and the fix plate, and the arrangements of the plurality of numerals inscribed on the rotating plate includes:

a first arrangement in which numerals respectively indicating dates of a first short month among the first short month, a second short month and a third short months whose month-end dates are not 31st day along a predetermined direction in order;

a second arrangement in which numerals respectively indicating dates from 1st day to a (predetermined number—1)th day and numerals indicating dates from a date which is a (predetermined number—2)th day earlier than a second month-end date of the second short month, to the second month-end date along the predetermined direction in order;

a third arrangement in which the numerals respectively indicating the dates from 1st day to the (predetermined number—1)th day and numerals indicating dates from a date which is a (predetermined number—2)th day earlier than a third month-end date of the third short month, to the third month-end date along the predetermined direction in order; and a fourth arrangement in which the numerals respectively indicating the dates from 1st day to the (predetermined number—1)th day and numerals indicating dates from a date which is a (predetermined number—2)th day earlier than a first month-end date of the first short month, to 31st day along the predetermined direction in order.

7. The date displaying apparatus according to claim 6, further comprising:

a date counting section to perform counting of a year, month, and day; and a rotating plate drive control section to electrically control the rotating plate to rotate based on data of the year, month, and day of the data counting section so that the predetermined number of numerals corresponding to the successive dates of the predetermined number including a current day are exposed from the aperture portion.

8. The date displaying apparatus according to claim 2, further comprising:

a hand to rotate on the fix plate to point a time;

a present time counting section to count a present time; and a hand drive control section to drive-control the hand based on present time data of the present time counting section.

9. The date displaying apparatus according to claim 7, wherein the predetermined number is three, and the rotating plate drive control section controls the rotating plate to rotate so as to expose a numeral indicating a date of a current day and numerals respectively indicating a previous date and a next date with respect to the current day based on the data of the year, month, and day of the data counting section.

10. The date displaying apparatus according to claim 7, wherein the predetermined number is seven;

seven days of a week are inscribed on an upper surface of the fix plate in parallel with the aperture portion; and the rotating plate drive control section controls the rotating plate to rotate so as to expose the seven numerals respectively indicating the successive seven dates including the current day correspondingly to the displayed seven days of the week based on the data of the year, month, and day of the data counting section.

* * * * *